US011384610B2

(12) United States Patent
McCraw

(10) Patent No.: US 11,384,610 B2
(45) **Date of Patent: *Jul. 12, 2022**

(54) CLOSED LOOP DRILLING MUD COOLING SYSTEM FOR LAND-BASED DRILLING OPERATIONS

(71) Applicant: National Oilwell Varco, L.P., Houston, TX (US)

(72) Inventor: Garry McCraw, Aberdeen (GB)

(73) Assignee: NATIONAL OILWELL VARCO, L.P., Houston, TX (US)

( * ) Notice: Subject to any disclaimer, the term of this patent is extended or adjusted under 35 U.S.C. 154(b) by 454 days.

This patent is subject to a terminal disclaimer.

(21) Appl. No.: 16/026,516

(22) Filed: Jul. 3, 2018

(65) Prior Publication Data

US 2018/0320462 A1 Nov. 8, 2018

Related U.S. Application Data

(63) Continuation of application No. 14/325,622, filed on Jul. 8, 2014, now Pat. No. 10,041,314.

(51) Int. Cl.

| | |
|---|---|
| ***E21B 21/06*** | (2006.01) |
| ***E21B 21/01*** | (2006.01) |
| ***E21B 36/00*** | (2006.01) |

(52) U.S. Cl.

CPC ..... *E21B 21/06* (2013.01); *E21B 21/01* (2013.01); *E21B 36/001* (2013.01)

(58) Field of Classification Search

CPC ..... E21B 21/06; E21B 21/01; E21B 36/001; F25B 5/04; F25B 7/00

See application file for complete search history.

(56) References Cited

U.S. PATENT DOCUMENTS

| | | | |
|---|---|---|---|
| 2,359,923 | A | 10/1944 | Lawless |
| 2,456,386 | A | 12/1948 | Cooper |
| 2,495,625 | A | 1/1950 | Bodinus |
| 2,748,884 | A | 6/1956 | Erwin |
| 3,399,739 | A | 9/1968 | Goodwin et al. |

(Continued)

FOREIGN PATENT DOCUMENTS

| | | | |
|---|---|---|---|
| AU | 2015287875 | B2 | 2/2017 |
| CA | 2377424 | A1 | 9/2003 |

(Continued)

OTHER PUBLICATIONS

Drill Cool Systems, Inc. brochure on The Geo-Cooler.

(Continued)

*Primary Examiner* — Larry L Furdge
*Assistant Examiner* — Alexis K Cox
(74) *Attorney, Agent, or Firm* — Schwegman Lundberg & Woessner, P.A.

(57) ABSTRACT

A method for cooling drilling mud includes controlling operation of a first closed-loop cooling system to cool a flow of drilling mud when a first temperature of the flow of drilling mud exceeds a first predetermined mud set point temperature, and controlling operation of a second closed-loop cooling system to further cool the flow of drilling mud when a second temperature of the flow of drilling mud that has been cooled by the first closed-loop cooling system exceeds a second predetermined mud set point temperature.

15 Claims, 4 Drawing Sheets

(56) References Cited

U.S. PATENT DOCUMENTS

| | | | | |
|---|---|---|---|---|
| 3,713,499 | A | 1/1973 | Arscott et al. | |
| 3,779,606 | A | 12/1973 | Hatcher et al. | |
| 3,859,812 | A | 1/1975 | Pavlak | |
| 3,876,367 | A | 4/1975 | Vorobeichikov et al. | |
| 4,093,514 | A | 6/1978 | Iljunin et al. | |
| 4,215,753 | A | 8/1980 | Champness | |
| 4,510,800 | A | 4/1985 | Prior | |
| 4,790,933 | A | 12/1988 | Quigley et al. | |
| 4,872,949 | A | 10/1989 | Wilwerding | |
| 5,005,655 | A | 4/1991 | Stokke et al. | |
| 5,107,874 | A | 4/1992 | Flanigan et al. | |
| 5,713,499 | A | 2/1998 | Daniel | |
| 5,715,895 | A * | 2/1998 | Champness | E21B 17/00 175/17 |
| 6,779,606 | B1 | 8/2004 | Lopez | |
| 10,041,314 | B2 | 8/2018 | Mccraw | |
| 2002/0162807 | A1* | 11/2002 | Kulbeth | B01D 21/0018 210/804 |
| 2003/0188864 | A1* | 10/2003 | Boudreau | C09K 8/34 166/270.1 |
| 2004/0000155 | A1* | 1/2004 | Cline | F24F 3/065 62/175 |
| 2004/0065095 | A1* | 4/2004 | Osborne | F24F 3/00 62/160 |
| 2005/0281131 | A1* | 12/2005 | Yungblut | B01F 5/0218 366/137 |
| 2006/0131247 | A1 | 6/2006 | Browne et al. | |
| 2007/0056913 | A1* | 3/2007 | Burt | C02F 1/52 210/721 |
| 2009/0145602 | A1* | 6/2009 | Reddy | C09K 8/467 166/250.14 |
| 2010/0170274 | A1* | 7/2010 | Ueda | F04D 27/0261 62/238.6 |
| 2011/0079391 | A1 | 4/2011 | Bedouet et al. | |
| 2012/0297801 | A1 | 11/2012 | Sun et al. | |
| 2013/0125842 | A1 | 5/2013 | Frick | |
| 2014/0116704 | A1* | 5/2014 | Reddy | C09K 8/885 166/300 |
| 2016/0010407 | A1 | 1/2016 | Mccraw | |

FOREIGN PATENT DOCUMENTS

| | | | |
|---|---|---|---|
| CA | 2953993 | A1 | 1/2016 |
| CA | 2953993 | C | 8/2018 |
| GB | 2542072 | A | 3/2017 |
| GB | 2542072 | B | 12/2018 |
| WO | 2004055320 | A1 | 7/2004 |
| WO | WO-2016007598 | A1 | 1/2016 |

OTHER PUBLICATIONS

Stacey Oil Services Ltd. internet posting re Mud Cooling Systems, Inc., 2004.

Chemwotei, "Geothermal Drilling Fluids," United Nations University, Reports 2011, No. 10, pp. 149-177.

Saito, "MWD and Downhole Motor Performance in Very High Temperature Geothermal Wells in Kakkonda, Japan," pp. 1451-1456.

Stacey Oil Services Ltd. brochure entitled "Mud Cooling Systems Overview—Haynesville".

Task Environmental Services Worldwide B.V. brochure entitled "Onshore Mudcooler T1500".

Alfalaval.com brochure entitled "Puma Onshore Drilling mud cooler".

International Search Report and Written Opinion of PCT/US2015/039509, dated Nov. 16, 2015.

International Search Report and Written Opinion of PCT/US2015/030317, dated Jan. 26, 2016.

Office Action from related U.S. Appl. No. 14/276,671 dated Aug. 23, 2016.

Great Britain Office Action dated Jan. 25, 2017 for GB Patent Application No. GB1622172.3.

Canadian Office Action dated Mar. 8, 2017 for Canadian Patent Application No. 2,953,993.

Australian Office Action dated Mar. 31, 2017 for Australian Patent Application No. 2015259412.

Communication Pursuant to Rules 161(1) and 162 EPC for European Application No. 15724895.6.

Canadian Office Action dated Sep. 27, 2017 for Canadian Patent Application No. 2,953,993.

United Kingdom Examination Report dated Jun. 22, 2018 for UK Patent Application No. 1622172.3.

"U.S. Appl. No. 14/325,622, Examiner Interview Summary dated Jan. 5, 2018", 5 pgs.

"U.S. Appl. No. 14/325,622, Examiner Interview Summary dated Dec. 28, 2017", 4 pgs.

"U.S. Appl. No. 14/325,622, Non Final Office Action dated Sep. 12, 2017", 26 pgs.

"U.S. Appl. No. 14/325,622, Notice of Allowance dated Apr. 9, 2018", 9 pgs.

"U.S. Appl. No. 14/325,622, Response filed Jan. 10, 2018 to Non Final Office Action dated Sep. 12, 2017", 27 pgs.

"U.S. Appl. No. 14/325,622, Response filed May 19, 2017 to Restriction Requirement dated Apr. 6, 2017", 16 pgs.

"U.S. Appl. No. 14/325,622, Restriction Requirement dated Apr. 6, 2017", 10 pgs.

"Canadian Application Serial No. 2953993, Office Action dated Mar. 8, 2017", 6 pgs.

"Canadian Application Serial No. 2953993, Office Action dated Sep. 27, 2017", 8 pgs.

"Canadian Application Serial No. 2953993, Response filed Mar. 23, 2018 to Office Action dated Sep. 27, 2017", 4 pgs.

"Canadian Application Serial No. 2953993, Response filed Sep. 1, 2017 to Office Action dated Mar. 8, 2017", 4 pgs.

"International Application Serial No. PCT/US2015/039509, International Preliminary Report on Patentability dated Jan. 19, 2017", 8 pgs.

U.S. Appl. No. 14/325,622 U.S. Pat. No. 10,041,314, filed Jul. 8, 2014, Closed Loop Drilling Mud Cooling System for Land-Based Drilling Operations.

"Saudi Arabian Application No. 517380674, Office Action dated Dec. 15, 2021", (w/ English Translation), 12 pgs.

* cited by examiner

CLOSED LOOP DRILLING MUD COOLING SYSTEM FOR LAND-BASED DRILLING OPERATIONS

CROSS-REFERENCE TO RELATED APPLICATIONS

This application is a continuation of U.S. patent application Ser. No. 14/325,622, filed Jul. 8, 2014, and is hereby incorporated by reference for all it contains.

BACKGROUND

1. Field of the Disclosure

The present subject matter is generally directed to drilling mud cooling systems, and in particular, to systems and methods that may be used for cooling drilling mud in onshore drilling applications.

2. Description of the Related Art

During a typical well drilling operation, such as when drilling an oil and gas well into the earth, a drilling mud circulation and recovery system is generally used to circulate drilling fluid, i.e., drilling mud, into and out of a wellbore. The drilling mud provides many functions and serves many useful purposes during the drilling operation, such as, for example, removing drill cuttings from the well, controlling formation pressures and wellbore stability during drilling, sealing permeable formations, transmitting hydraulic energy to the drilling tools and bit, and cooling, lubricating, and supporting the drill bit and drill assembly during the drilling operations.

Drilling muds commonly include many different types of desirable solid particles that aid in performing one or more of the functions and purposes outlined above. The solids particles used in drilling muds may have one or more particular properties which make their presence in a given drilling mud mixture desirable and beneficial. For example, some solids particles may need to be of a certain size or size range, which may be useful in sealing off more highly permeable formations so as to prevent the loss of valuable drilling fluid into the formation—so-called "lost circulation materials." Other solids particles may need to be of a certain density so as to control and balance forces within the wellbore, which may be added to the drilling mud as required to guard against wellbore collapse or a well blowout during the drilling operations. High density particulate materials, such as barium sulfate, or barite, ($BaSO_4$), and the like are often used for this purpose, as their greater unit volumetric weight serves to counterbalance high formation pressures and/or the mechanical forces caused by formations that would otherwise cause sloughing. In still other cases, solids particles may be added to the drilling mud based on a combination of the particle size and density, such as when a specific combination of the two properties may be desirable. Furthermore, the drilling mud in general, and the added solid particles in particular, can be very expensive. As such it is almost universally the case that, upon circulation out of the wellbore, the desirable—and valuable—solids particles are generally recovered and re-used during the ongoing drilling cycle.

Once the drilling mud has served its initial purposes downhole, the mud is then circulated back up and out of the well so that it can carry the drill cuttings that are removed from the advancing wellbore during the drilling operation up to the surface. As may be appreciated, the drill cuttings, which are also solids particles, are generally thoroughly mixed together with the desirable solids particles that, together with various types of fluids, make up the drilling mud, and therefore must be separated from the desirable solids particles, such as barite and the like. In the best possible drilling scenario, it is advantageous for the drill cuttings to be substantially larger than the desirable solids particles making up the drilling mud, thus enabling most of the drill cuttings to be removed using vibratory separator devices that separate particles based upon size, such as shale shakers and the like. However, in many applications, a portion of the drill cuttings returning with the drilling mud are similar in size, or even smaller than, at least some of the desirable solids particles contained in the drilling mud, in which case secondary separation devices, such as hydrocyclone and/or centrifuge apparatuses, are often employed so as to obtain further particle separation.

There are a variety of reasons why it is desirable, and even necessary, to remove as many of the drill cuttings particles from the drilling mud mixture as possible. A first reason would be so as to control and/or maintain the drilling mud chemistry and composition within a desirable range as consistently as possible. For example, the presence of drill cuttings particles in the drilling mud mixture may have a significant effect on the weight of the mud, which could potentially lead to wellbore collapse, and/or a blowout scenario associated with overpressure conditions within the well. More specifically, since the specific gravity of the drill cuttings particles are often significantly lower than that of the desired solids particles in the drilling mud, e.g., barite, the presence of cuttings particles left in the mud by the typical solids removal processes can cause the weight of the drilling mud to be lower than required in order to guard against the above-noted drilling conditions.

The temperature of the drilling mud may also significantly increase as it is being circulated down into and back up out of the drilled wellbore, particularly in high pressure and/or high temperature drilling operations. Elevated drilling mud temperatures can generally cause increased wear and tear on mud circulation equipment, thus potentially leading to premature equipment failure, increased frequency of equipment maintenance, associated shutdown (or non-productivity) time, and/or reduced overall equipment efficiency, thus adversely impacting overall drilling costs. Additionally, high drilling mud temperatures can also have a negative influence on the operation and/or performance of measurement while drilling (MWD) equipment, such as high signal attenuation and the like, or even a loss of communication with the MWD equipment during drilling operations. According, and depending on the specific downhole temperature conditions during drilling operations, the drilling mud must often be cooled prior to it being recirculating back down into the wellbore.

FIG. 1 schematically depicts a representative prior art drilling mud system 100 that is used to circulate and treat drilling mud during a typical drilling operation. As shown in FIG. 1, a blow-out preventer (BOP) 103 is positioned on a wellhead 102 as drilling operations are being performed on a wellbore 101. In operation, hot drilling mud **110*h* mixed with drill cuttings 107 is circulated out of the wellbore 101 and exits the BOP 103 through the bell nipple 104, and thereafter flows through the flow line 105 to the drill cuttings separation equipment 106. As noted above, depending on the particle sizes of the returning drill cuttings 107 and the degree of particle separation required, the drill cuttings separation equipment 106 may include first stage separating equipment, such as one or more vibratory separators (e.g., shale shakers), as well as second stage separating equipment, such as one or more hydrocyclone and/or centrifuge apparatuses. However, for simplicity of illustration and discussion, the drill cuttings separation equipment 106 has been schematically depicted in FIG. 1 as a shale shaker device, and therefore will hereafter be referred to as the shale shaker 106**.

After entering the shale shaker 106, the undesirable drill cuttings 107 are separated from the hot drilling mud 110*h* and directed to a waste disposal tank or pit 108. The separated hot drilling mud 110*h* then flows from the sump 109 of the shale shaker 106 to a hot mud pit or hot mud tank 111*h*. Typically, the hot mud tank 111*h* is a large container having an open top so that the hot drilling mud 110*h* can be exposed to the environment. In this way, at least some of the heat that is absorbed by the drilling mud during the drilling operation (e.g., from the surrounding formation and/or from the generation of drill cuttings) can be released to the environment, thus allowing the hot drilling mud 110*h* to naturally cool, as indicated by heat flow lines 113.

In some applications, the temperature of the hot drilling mud 110*h* exiting the bell nipple 104 and flowing to the separation equipment (shale shaker) 106 can be as high as approximately 175° F.-225° F. It should be appreciated that the degree of natural or passive cooling that can take place in the hot mud tank 111*h* is generally limited by the surrounding environmental conditions, such as ambient temperature and/or relative humidity, which can be affected by numerous factors. For example, some such natural cooling factors include the geographical location of the wellbore drilling site (e.g., artic, temperate, tropical, and/or equatorial regions, etc.), the time of year (e.g., the season or month), and even the time of day (e.g., night or day). Therefore, the amount of passive cooling is typically only incremental in nature, e.g., limited to no more than approximately a 5° F. reduction in mud temperature. In such cases, an enhanced degree of mud cooling is often required so as to further reduce the drilling mud temperature to a manageable level.

When additional mud cooling is required, the hot drilling mud 110*h* is further cooled in a mud cooler, such as the prior art mud cooler 130 shown in FIG. 1. In the configuration depicted in FIG. 1, a hot mud pump 131 is used to pump the hot drilling mud 110*h* from the hot mud tank 111*h* to a mud coil 132 of the mud cooler 130. As the hot drilling mud 110*h* passes through the mud coil 132, a water feed pump 134 is used to pump water 135 from a water tank 136 to an internal spray header 137, which sprays the water 135 downward over the mud coil 132. Simultaneously, one or more induced draft fans 133 located at the top of the mud cooler 130 generate an upward flow of air 138 across the mud coil 132. In operation, the downward spray of water 135 from the spray header 137 and the upward flow of air 138 through the fans 133 acts to cool the hot drilling mud 110*h* flowing through the mud coil 132 by a combination of evaporative cooling and quenching of the coil, as indicated by the heat flow lines 139. Water 135 sprayed from the internal spray header 134 is collected in a collection tray or collection tank 140 at the bottom of the mud cooler 130, from which it is then pumped back to the water tank 136 by a water recycle pump 141 for further mud cooling operations in the mud cooler 130, as described above. Under optimal conditions, a typical prior art mud cooler that is configured and operated in similar fashion to the mud cooler 130 shown in FIG. 1 can generally achieve a further mud temperature reduction that ranges from 15° F.-20° F.

After the above-described mud cooling process, cooled drilling mud 110*c* exits the mud cooler 130. In some configurations of the prior art system 100, the cooled drilling mud 110*c* is directed to a cooled mud tank 111*c*, where it may be further treated by adding desired solids and/or chemicals so as to appropriately adjust the rheology and/or other characteristics of the mud prior to pumping the cooled drilling mud 110*c* back into the wellbore 101. Additionally, a further incremental temperature reduction of the mud 110*c* may again occur in the cooled mud tank 111*c* by way of passive cooling 113 to the ambient environment, as previously described with respect to the hot mod tank 111*h*.

As shown in FIG. 1, after the above described separating, cooling, and/or treating operations, the drilling mud 110*c* flows from the cooled mud tank 111*c* to a mud pump 116 through the suction line 115. In some applications, a mud booster pump 114 may be used to deliver the drilling mud 110 through the suction line 115 and to the suction side of the mud pump 116. In operation, the mud pump 116 increases the pressure of the drilling mud 110 and discharges the pressurized drilling mud 110 to a standpipe 117, after which the mud 110 flows through a rotary line 118 to a swivel 119 mounted at the upper end of a kelly 120. The kelly 120 then directs the drilling mud 110*c* down to the drill pipe/drill string 121, and the mud 110*c* is recirculated down the drill string 121 to a drill bit (not shown), where it once again provides, among other things, the cooling, lubrication, and drill cutting removal tasks previously described.

In other configurations, the system 100 may not include the cooled mud tank 111*c* shown in FIG. 1, or the system 100 could be configured to include appropriate valving so that the cooled mud tank 111*c* can be bypassed. In such configurations, the cooled drilling mud 110*c* flows directly from the mud cooler 130 and through the suction line 115 to the suction side of the mud pump 116, where it is then pumped back into the wellbore 101 as previously described.

Additionally, the prior art system 100 can also be configured in such a way so that it can be operated in a mud cooler bypass mode. For example, as shown in FIG. 1, appropriate valving can be positioned within the system 100 and operated in such a way as to isolate the mud cooler 130 from the flow of hot drilling mud 110*h* exiting the hot mud tank 111*h*. In such configurations, the system 100 can be operated so that the hot mud 110*h* flows directly from the hot tank 111*h* to the cooled mud tank 111*c*, e.g., through a mud cooler bypass line 130*b*. It should also be appreciated that when a cooled mud tank 111*c* is not provided, or when the cooled mud tank 111*c* is also bypassed (as described above), the hot drilling mud 110*h* will flow directly to the mud pump 116. Such operational configurations can be used when maintenance is required on the mud cooler 130, or during drilling operations wherein the temperature of the hot drilling materials mixture exiting the wellbore 101 does not require any additional cooling beyond the incremental passive capabilities of the hot and/or cold mud tanks 111*h* and 111*c*.

It should be appreciated that, even when a mud cooler 130 is included in the system 100, various conditions and/or operational parameters can act to detrimentally impact the overall mud temperature reduction capabilities of the system 100, and can also contribute to an increase in overall drilling costs. More specifically, as noted above, the passive cooling capabilities of the hot and/or cold mud tanks 111*h* and 111*c* are generally significantly influenced by the surrounding environmental conditions at a given wellbore drilling site. For example, in regions where the ambient temperature conditions can be very high (e.g., 100° F. or higher)—such as in Middle Eastern, northern African, southern United States, and/or Central American locations—the passive natural cooling effects obtained from the mud tanks 111*h* and/or 111*c* can be severely limited, such as a maximum of approximately 5° F. reduction in mud temperature, or even less. In similar fashion, such high temperature and/or high relative humidity environments can also reduce the evaporative cooling effects of the mud cooler 130, such that the maximum temperature reduction achievable under such conditions is no more than approximately 10° F.-15° F., or even less. Therefore, even when the mud cooler 130 is employed as part of the system 100, the drilling mud temperature can often remain at or above approximately 150° F.-175° F.

Additionally, due to the quenching effects of the water spray system (i.e., elements 134-140) described above, the hot drilling mud 110*h* circulating through the mud coil 132 can often cake up and adhere to the inside surfaces of the coil 132. Such mud caking effects can reduce the available flow area through the mud coil 132, thus increasing pressure drop through the coil 132. Furthermore, the insulating effects attributable to the caked layer of drilling mud on the inside surfaces of the mud coil 132 can also directly reduce the overall heat transfer/cooling capabilities of the mud cooler 130. Moreover, due to the mud caking inside of the mud coil 132, the mud cooler 130 must also be bypassed and shut down on a periodic basis for cleaning and maintenance, so that the caked drilling mud can be removed from the coil 132. Accordingly, during such periodic cleaning and maintenance activities, the only mud cooling provided by the system 100 is the relatively small amount of passive incremental cooling 113 that occurs naturally to the surrounding environment, e.g., from the hot and/or cold mud tanks 111*h* and 111*c*.

Furthermore, due to the basic evaporative cooling effects of the mud cooler 130, it should be understood that some amount of the water 135 circulating through the cooler 130 will continuously be lost to the surrounding environment. For example, and depending on the specific ambient conditions in the area where the drilling operations are being performed, as much as 15-20 gallons per minute (gpm), or even more, of the water 135 may be lost to the ambient atmosphere during the operation of the mud cooler 130. Consequently, the supply of water 135 that is lost to the surrounding environment must periodically be replenished, such as from a portable water tanker 142, as shown in FIG. 1. Furthermore, it should be appreciated that in at least some remote and/or desert-like locations, such as drilling sites located in the Middle East and the like, water is oftentimes a precious commodity that may command a significant price, a situation that may be compounded by the generally high local ambient temperatures. Therefore, the replenishment of significant water losses to the surrounding environment during operation of the mud cooler 130 can have a substantial impact on the overall costs of drilling.

Accordingly, there is a need in the drilling industry for a mud cooling system that is less susceptible to the vagaries of the surrounding environmental conditions, and which does not require a continuous replenishment of a cooling water supply. The present disclosure is directed to mud cooling systems and methods of operating the same that may be used to mitigate, or possibly even eliminate, at least some of the problems associated with the prior art mud cooling systems described above.

SUMMARY OF THE DISCLOSURE

The following presents a simplified summary of the present disclosure in order to provide a basic understanding of some aspects disclosed herein. This summary is not an exhaustive overview of the disclosure, nor is it intended to identify key or critical elements of the subject matter disclosed here. Its sole purpose is to present some concepts in a simplified form as a prelude to the more detailed description that is discussed later.

Generally, the subject matter disclosed herein is directed to various new and unique systems, apparatuses, and methods for circulating and cooling drilling mud during wellbore drilling operations, and in particular, for high temperature drilling operations in onshore applications. In one illustrative embodiment, a method for cooling drilling mud is disclosed that includes, among other things, controlling operation of a first closed-loop cooling system to cool a flow of drilling mud when a first temperature of the flow of drilling mud exceeds a first predetermined mud set point temperature, and controlling operation of a second closed-loop cooling system to further cool the flow of drilling mud when a second temperature of the flow of drilling mud that has been cooled by the first closed-loop cooling system exceeds a second predetermined mud set point temperature.

In another exemplary embodiment disclosed herein a method for cooling drilling mud includes controlling operation of a first closed-loop cooling system to cool a flow of drilling mud when a first temperature of the flow of drilling mud exceeds a first predetermined mud set point temperature, wherein controlling the operation of the first closed-loop cooling system includes circulating a first cooling fluid through the first closed-loop cooling system and cooling the flow of drilling mud with the first cooling fluid. Furthermore, the illustrative method also includes controlling operation of a second closed-loop cooling system to further cool the flow of drilling mud when a second temperature of the flow of drilling mud that has been cooled by the first closed-loop cooling system exceeds a second predetermined mud set point temperature, wherein controlling the operation of the second closed-loop cooling system includes circulating a second cooling fluid through the second closed-loop cooling system and cooling the flow of drilling mud with the second cooling fluid.

BRIEF DESCRIPTION OF THE DRAWINGS

The disclosure may be understood by reference to the following description taken in conjunction with the accompanying drawings, in which like reference numerals identify like elements, and in which.

Figure 1:
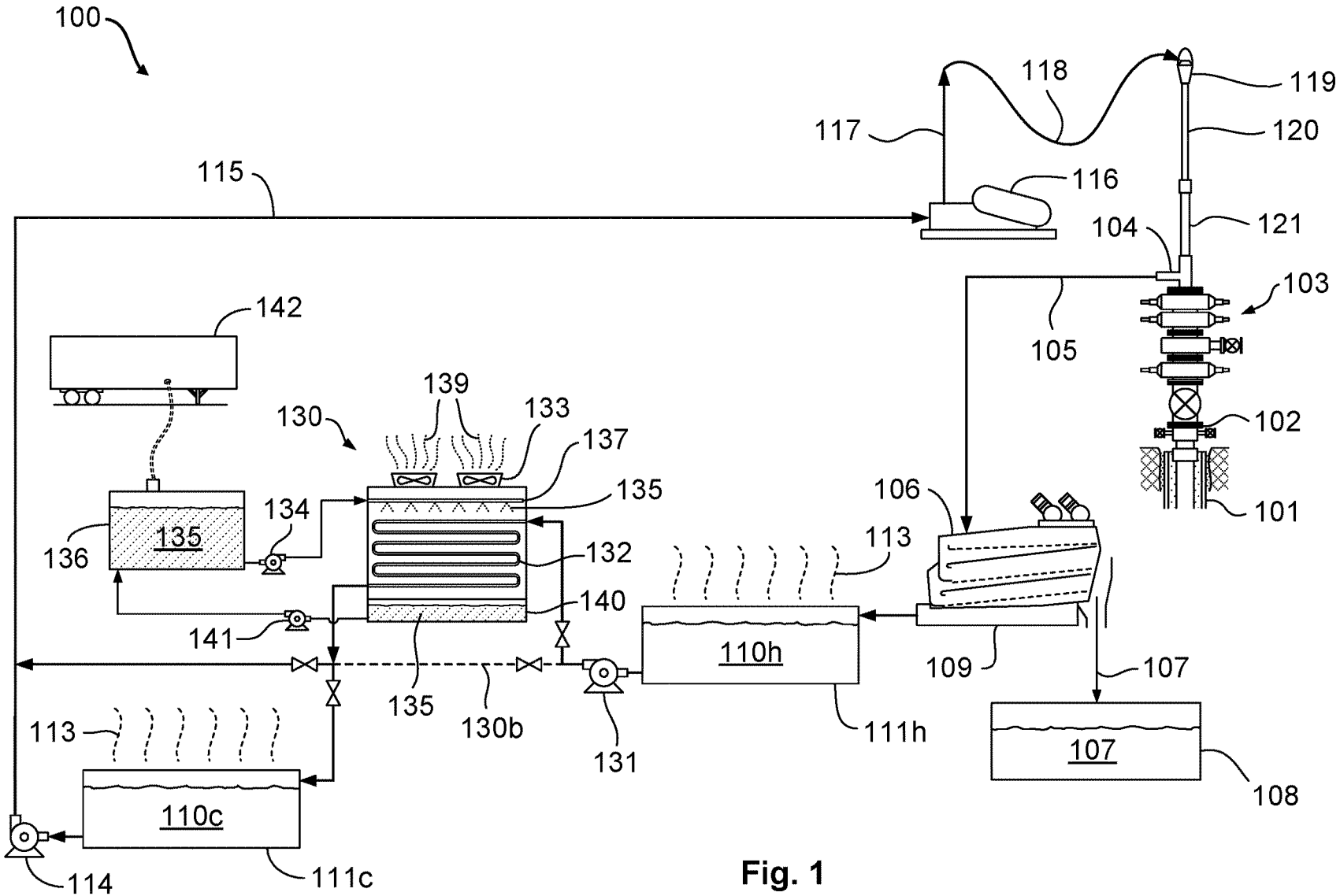
Fig. 1 (Prior Art)
FIG. 1 schematically depicts a representative prior art drilling mud system.

While the subject matter disclosed herein is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention.

DETAILED DESCRIPTION

Various illustrative embodiments of the present subject matter are described below. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The present subject matter will now be described with reference to the attached figures. Various systems, structures and devices are schematically depicted in the drawings for purposes of explanation only and so as to not obscure the present disclosure with details that are well known to those skilled in the art. Nevertheless, the attached drawings are included to describe and explain illustrative examples of the present disclosure. The words and phrases used herein should be understood and interpreted to have a meaning consistent with the understanding of those words and phrases by those skilled in the relevant art. No special definition of a term or phrase, i.e., a definition that is different from the ordinary and customary meaning as understood by those skilled in the art, is intended to be implied by consistent usage of the term or phrase herein. To the extent that a term or phrase is intended to have a special meaning, i.e., a meaning other than that understood by skilled artisans, such a special definition will be expressly set forth in the specification in a definitional manner that directly and unequivocally provides the special definition for the term or phrase.

In general, the present disclosure is directed to various systems, apparatuses, and methods that may be used for circulating and cooling drilling mud during wellbore drilling operations, and in particular, during high temperature drilling operations in onshore applications.

Figure 2A:
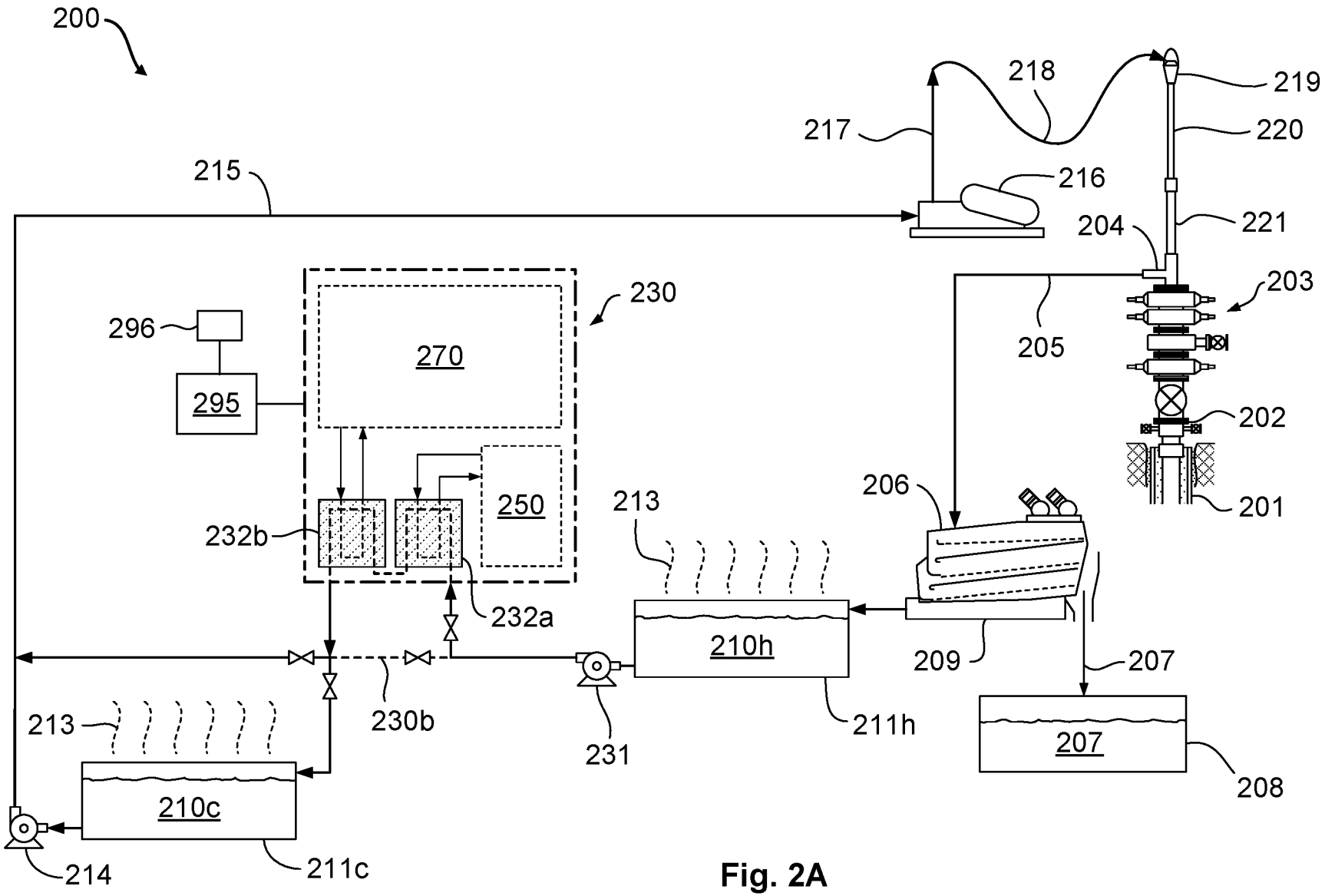
FIG. 2A schematically depicts one illustrative embodiment of a drilling mud system disclosed herein.

FIG. 2A schematically depicts one illustrative embodiment of a drilling mud system 200 in accordance with the present disclosure that may be used to circulate, cool, and treat drilling mud during a typical drilling operation. As shown in FIG. 2A, a blow-out preventer (BOP) 203 may be positioned on a wellhead 202 as drilling operations are being performed on a wellbore 201. In operation, hot drilling mud 210*h* mixed with drill cuttings 207 may be circulated out of the wellbore 201 and exits the BOP 203 through the bell nipple 204, after which the hot mixture flows through the flow line 205 to the drill cuttings separation equipment 206. As noted previously, the drill cuttings separation equipment 206 may include first stage separating equipment, such as one or more vibratory separators (e.g., shale shakers), as well as second stage separating equipment, such as one or more hydrocyclone and/or centrifuge apparatuses. However, for simplicity of illustration and discussion, the drill cuttings separation equipment 206 has been schematically depicted in FIG. 2A as a shale shaker device, and therefore will hereafter be referred to as the shale shaker 206.

After entering the shale shaker 206, the undesirable drill cuttings 207 may be separated from the hot drilling mud 210*h* and directed to a waste disposal tank or pit 208. Thereafter, the separated hot drilling mud 210*h* may then flow from the sump 209 of the shale shaker 206 to a hot mud pit or tank 211*h*. In some exemplary embodiments, the hot mud tank 211*h* may be a large container having an open top, thereby exposing the hot drilling mud 210*h* to the ambient atmosphere. Accordingly, at least a portion of the heat that is absorbed by the drilling mud during the drilling operations (e.g., from the surrounding formation and/or from the generation of drill cuttings) may be released to the surrounding environment, thus allowing the hot drilling mud 210*h* to cool passively or naturally, as indicated by heat flow lines 213.

In certain embodiments of the system 200, a hot mud pump 231 may be used to pump the hot drilling mud 210*h* from the hot mud tank 211*h* to a drilling mud cooler 230, which may hereinafter in some cases be referred to simply as a mud cooler 230. The mud cooler 230 may include a first stage mud heat exchanger 232*a* that is thermally coupled to a first stage closed-loop cooling system 250 and a second stage mud heat exchanger 232*b* that is thermally coupled to a second closed-loop cooling system 270. As shown in FIG. 2A, the hot drilling mud 210*h* may initially flow through the first stage mud heat exchanger 232*a*, where at least a portion of the heat contained in the hot drilling mud 210*h* is exchanged with the first stage closed-loop cooling system 250, and then into the second stage mud heat exchanger 232*b*, where a further portion of heat is exchanged with the second closed-loop cooling system 270, as will be further described in conjunction with FIG. 2C below. Thereafter, cooled drilling mud 210*c* flows out of the second stage mud heat exchanger 232*b* and out of the mud cooler 230 for further circulation through the system 200. Additionally, in at least some embodiments, a control system 295 may be operatively coupled to the mud cooler 230, and the control system 295 may be adapted to control the operation of the various elements of the mud cooler 230 so as to achieve a predetermined set point temperature of the cooled drilling mud 210*c*.

As noted previously, after the above-described mud cooling process, the cooled drilling mud 210*c* exits the mud cooler 230. In certain illustrative embodiments, the cooled drilling mud 210*c* may be directed to a cooled mud tank 211*c*, where it may be further treated by adding desired solids and/or chemicals so as to appropriately adjust the rheology and/or other characteristics of the mud prior to pumping the cooled drilling mud 210*c* back into the wellbore 201. Furthermore, an additional amount of incremental temperature reduction of the cooled drilling mud 210*c* may also occur in the cooled mud tank 211*c* by way of passive cooling 213 to the ambient environment, as previously described with respect to the hot mud tank 211*h*. Additionally, while the system 200 shown in FIG. 2A depicts the hot mud tank 211*h* as being separate from the cooled mud tank 211*c*, it should be appreciated that FIG. 2A is a schematic illustration only. As such, in at least some embodiments the hot mud tank 211*h* and the cooled mud tank 211*c* may be separate chambers of a larger common mud tank. Moreover, either or both of the hot and cooled mud tanks 211*h* and 211*c* may be configured to have separate chambers (not shown), such as, for example, chambers that may be separated by overflow weirs and the like so as to thereby maximize the residence time of the drilling mud as it flows through each tank, thus enhancing the passive cooling 213 in the tanks 211*h*, 211*c*.

As shown in FIG. 2A, after the drilling mud has been cooled and/or treated as described above, a flow of the cooled drilling mud 210*c* may then be directed from the cooled mud tank 211*c* to a mud pump 216 through the mud pump suction line 215. In some embodiments, a mud booster pump 214 may be used to pump the cooled drilling mud 210*c* through the suction line 215 and to the suction side of the mud pump 216. Thereafter, the mud pump 216 may be operated so as to increase the pressure of the cooled drilling mud 210*c* and to discharge the pressurized mud 210*c* to a standpipe 217, from which the mud 210 may flow through a rotary line 218 to a swivel 219 mounted at the upper end of a kelly 220. The kelly 220 may then direct the flow of cooled drilling mud 210*c* down to the drill pipe/drill string 221, after which the mud 210*c* may be recirculated down the drill string 221 to a drill bit (not shown), where it once again may provide the cooling, lubrication, and drill cutting removal tasks previously described.

In other exemplary embodiments, the system 200 may not include the cooled mud tank 211*c* depicted in FIG. 2A, or the system 200 may be configured to include appropriate valving so that the cooled mud tank 211*c* can be bypassed during system operation. In such embodiments, the cooled drilling mud 210*c* may flow directly from the mud cooler 230 to the suction line 215, where it may then be directed to the suction side of the mud pump 216 and pumped back into the wellbore 201 as previously described.

In still other illustrative embodiments, the system 200 of FIG. 2A may be configured in such a way so that it can be operated in a mud cooler bypass mode when maintenance is required on the mud cooler 230. For example, as shown in FIG. 2A, appropriate valving may be positioned within the system 200 and operated so as to isolate the mud cooler 230 from the flow of hot drilling mud 210*h* that is pumped from the hot mud tank 211*h* by the hot mud pump 231. Furthermore, in such embodiments the system 200 may be operated so that the hot mud 210*h* flows directly from the hot tank 211*h* to the cooled mud tank 211*c*, e.g., through a mud cooler bypass line 230*b*. Additionally, it should also be appreciated that in those embodiments wherein a cooled mud tank 211*c* may not be provided, or when the cooled mud tank 211*c* is also bypassed (as described above), the flow of hot drilling mud 210*h* may be controlled so as to flow directly to the mud pump 216.

Figure 2B:
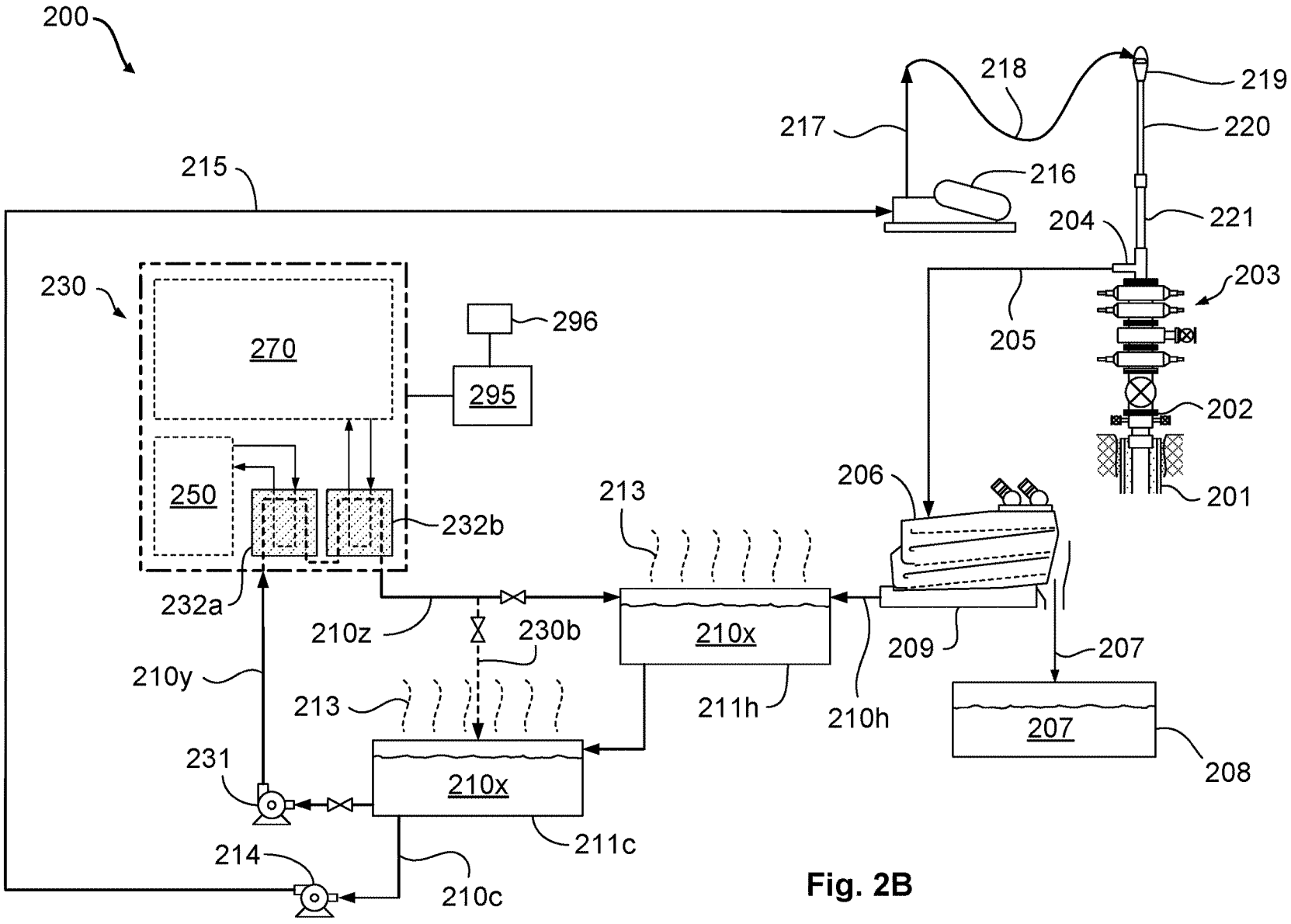
FIG. 2B schematically illustrates another exemplary drilling mud system in accordance with the present disclosure.

FIG. 2B schematically depicts another exemplary embodiment of the drilling mud system 200 that is similar in many respects to the system 200 shown in FIG. 2A, except that the drilling mud flow between the various components of the system 200 illustrated in FIG. 2B has been differently configured. For example, as with the system 200 shown in FIG. 2A, the system 200 of FIG. 2B includes substantially the same major components, such as the wellhead 202 and BOP 203, the shale shaker 206, the hot mud tank 211*h*, the cooled mud tank 211*c*, the mud cooler 230, and the mud pump 216. However, rather than circulating the drilling mud from the hot mud tank 211*h* to the mud cooler 230 as shown in FIG. 2A, the system 200 of FIG. 2B is configured so that the drilling mud entering the mud cooler 230 flows instead from the cooled mud tank 211*c*, as will be further described below.

As with the system 200 of FIG. 2A, after the undesirable drill cuttings 207 have been separated from the hot drilling mud 210*h*, the separated hot drilling mud 210*h* may then flow to the hot mud tank 211*h*. However, in some embodiments, the hot drilling mud 210*h* flowing into the hot mud tank 211*h* may be mixed in the tank 211*h* with a cooled drilling mud 210*z* that is flowing from the mud cooler 230 (where it has been cooled as described with respect to FIG. 2A above), thus forming the drilling mud mixture 210*x*. As previously described, the drilling mud mixture 210*x* may experience some amount of passive cooling 213 while in the hot mud tank 211*h*. The drilling mud mixture 210*x* may then flow directly from the hot mud tank 211*h* to the cooled mud tank 211*c*, where an additional amount of passive cooling 213 may occur so as to further reduce the temperature of the mud mixture 210*x*.

As shown in FIG. 2B, the mud circulation pump 231 may then be used to circulate a portion of the drilling mud mixture 210*x* (identified in FIG. 2B as drilling mud 210*y*) from the cooled mud tank 211*c* to the mud cooler 230, which is configured as described above with respect to FIG. 2A. Additionally, another portion of the drilling mud mixture 210*x*, identified as cooled drilling mud 210*c*, is circulated from the cooled mud tank 211*c* through the mud suction line 215 to the mud pump 216, e.g., by the mud booster pump 214, and back down the wellbore 201 in the manner described with respect to FIG. 2A above.

In certain embodiments, after being cooled in the mud cooler 230, the drilling mud mixture 210*y* may then flow back to the hot mud tank 211*h* as the cooled drilling mud 210*z*, where it may then mix with the hot drilling mud 210*h* flowing from the shale shaker 206 so as to form the drilling mud mixture 210*x* as described above. As with the system 200 of FIG. 2A, the control system 295 may control the operation of the various elements of the mud cooler 230 so as to achieve a predetermined set point temperature of the cooled drilling mud 210*z*.

When drilling mud is circulated through the system 200 in the manner described above, the residence time of the drilling mud mixture 210*x* in the hot and cooled mud tanks 211*h* and 211*c* may be increased. This is due at least in part to the portion 210*y* of the drilling mud mixture 210*x* that is circulated through the mud cooler 230, from which it then exits as cooled drilling mud 210*z* and subsequently re-enters the hot mud tank 211*h*, where it then mixes with the hot drilling mud 210*h*. This increased residence time increases the amount of passive cooling 213 that may occur. Furthermore, the recirculation of a portion 210*y* of the drilling mud mixture 210 from the hot mud tank 211*h*, to the cold mud tank 211*c*, through the mud cooler 230, and back to the hot mud tank 211*h* also allows the mud to be cooled more than one time. This mud recirculation thus acts to further reducing the temperature of the cooled drilling mud 210*c* flowing from the cooled mud tank 211*c* and back through the suction line 215 to the mud pump 216 for pumping into the wellbore 201.

In certain illustrative embodiments, the system 200 of FIG. 2B may also be configured and operated in such a manner that the cooled drilling mud 210*z* is mixed with the hot drilling mud 210*h* in the cooled mud tank 211*c*, rather than in the hot mud tank 211*h* as described above. For example, a bypass line 230*b* and appropriate valving may be positioned between the mud cooler 230 and the hot mud tank 211*h*, as shown in FIG. 2B. During operation of the system 200, the valving may then be actuated as desired so as to direct the cooled drilling mud 210*z* exiting the mud cooler 230 through the bypass line 230*b* to the cooled mud tank 211*c*. Furthermore, the system 200 may be controlled such that this hot mud tank bypass mode is actuated as necessary so as to meet predetermined mud set point temperature for the cooled mud 210*c* flowing from the cooled mud tank 211*c* to the mud pump 216.

As noted with respect to the system 200 of FIG. 2A above, in at least some exemplary embodiments, the hot mud tank 211*h* and the cooled mud tank 211*c* may be separate chambers of a larger common mud tank. Furthermore, the cooled mud tank 211*c* may be configured to have separate chambers (not shown), such as, for example, chambers that may be separated by overflow weirs and the like. In such embodiments, the bypass line 230*b* may be configured to return the cooled drilling mud 210*z* exiting the mud cooler 230 to the same chamber of the cooled mud tank 211*c* where the drilling mud mixture 210*x* from the hot mud tank 211*h* enters the cooled mud tank 211*c*—i.e., where the mud in the tank 211*c* may be hottest. Furthermore, the cooled mud tank 211*c* may be configured such that the drilling mud 210*y* and the cooled drilling mud 210*c* are drawn from a chamber that is at an opposite end of the tank 211*c* from the chamber where the cooled drilling mud 210*z* and/or the hot drilling mud 210*h* enter the tank 211*c*—i.e., where the mud in the tank 211*c* may be coolest. In this way, the residence time of the recirculated cooled mud 210*z* in the cooled mud tank 211*c* may be maximized, thus also substantially maximizing the passive cooling 213 of the drilling mud mixture 210*x*. Of course, it should be appreciated that other configurations of the bypass line 230*b* and cooled mud tank 211*c* may also be used, depending on the overall design parameters and/or mud cooling requirements of the system 200.

In some embodiments, the system 200 of FIG. 2B may be operated in a mud cooler bypass mode when maintenance is required on the mud cooler 230. For example, as shown in FIG. 2B, appropriate valving may be positioned in the flow line between the cooled mud tank 211*c* and the mud cooler 230 operated so as to isolate the mud cooler 230 from the flow of drilling mud 210*y* that is pumped from the cold mud tank 211*c* by the mud circulation pump 231. In such embodiments, the system 200 may be operated so that the hot mud 210*h* flows directly from the hot tank 211*h* to the cooled mud tank 211*c* and from the cooled mud tank 211 to the mud pump 216, e.g., without recirculating the portion 210*y* of drilling mud through the mud cooler 230 and/or back through the hot mud tank 211*h*.

Figure 2C:
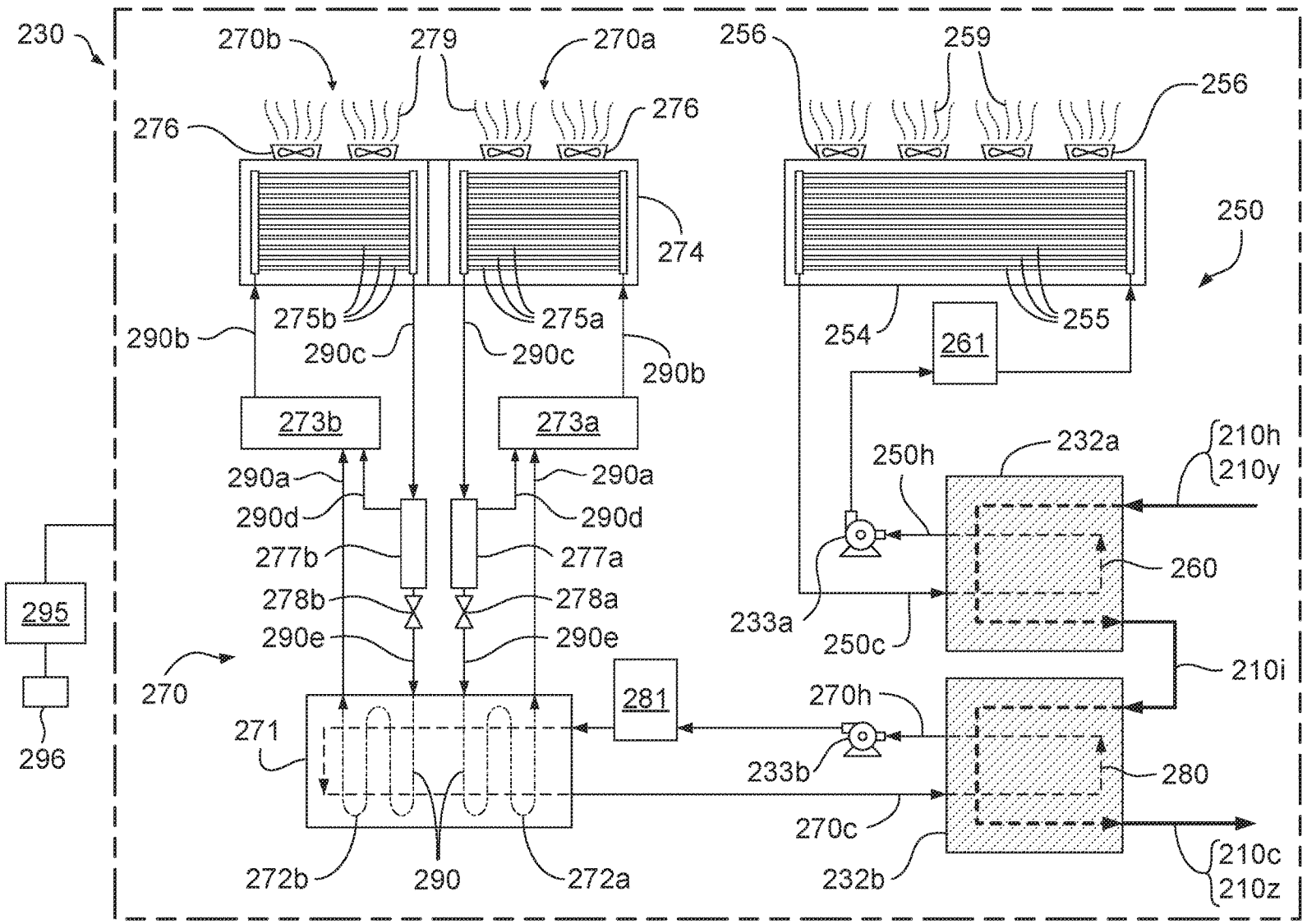
FIG. 2C schematically depicts an exemplary drilling mud cooler that may be used in conjunction with either of the drilling mud systems shown in FIGS. 2A and 2B in accordance with one illustrative embodiment of the present disclosure.

FIG. 2C is a more detailed schematic diagram of the mud cooler 230 that may be used in conjunction with either of the drilling mud systems 200 depicted in FIGS. 2A and 2B. As shown in FIG. 2C, the hot drilling mud 210*h* of FIG. 2A (or the drilling mud 210*y* of FIG. 2B) initially enters the first stage mud heat exchanger 232*a*, which is thermally coupled to the first stage closed-loop cooling system 250 by a first stage cooling liquid 260 that is circulated through both the first stage mud heat exchanger 232*a* and the first stage closed-loop cooling system 250. In the first stage mud heat exchanger 232*a*, a portion of the heat contained in the hot drilling mud 210*h*/210*y* is exchanged with the first stage cooling liquid 260 that subsequently flows through and is cooled by the first stage closed-loop cooling system 250. The cooling liquid 260 may be any suitable cooling liquid, such as water or a water/glycol mixture and the like. Furthermore, in some embodiments the cooling liquid 260 may be circulated through the first stage mud heat exchanger 232*a* and the first stage closed-loop cooling system 250 by a first stage fluid circulation pump 233*a*, as shown in FIG. 2C.

For purposes of the present disclosure and the appended claims, a "closed-loop cooling system" should be understood as one wherein the same cooling liquid, e.g., water or a water/glycol mixture, is continuously circulated through the system without any cooling liquid losses from the system to the environment, and without any cooling liquid being added to the system during normal operations. Accordingly, it should be understood that, unlike the water spray system 134-140 that is employed in the prior art mud cooler 130, a continuous replenishment of cooling liquid 260 is generally not required when the first stage closed-loop cooling system 250 is operated under normal conditions.

In operation, the cooling liquid 260 is heated in the first stage mud heat exchanger 232*a* by the hot drilling mud 210*h*/210*y*, and the heated cooling liquid 260 exits the first stage mud heat exchanger 232*a* at a temperature 250*h*. The first stage fluid circulation pump 233*a* may then pump the heated cooling liquid 260 to the first stage closed-loop cooling system 250, where it passes through the cooling coil 255 of an air cooled heat exchanger 254, which may hereafter be referred to in shorthand fashion as an "air cooler" in the following description and in the appended claims. A plurality of induced draft cooling fans 256 mounted on the air cooler 254 may then cool the cooling liquid 260 by drawing a flow of air across the cooling coil 255 so as to reject the heat absorbed by the cooling liquid 260 in the first stage mud heat exchanger 232*a* by dissipating the heat to the atmosphere, as indicated schematically by the heat flow lines 259 shown in FIG. 2C. After being cooled in the air cooler 254, the cooled cooling liquid 260 may then be circulated out of the first stage closed-loop cooling system 250 and back to the first stage mud heat exchanger 232*a*, where it enters the first stage exchanger 232*a* at a temperature 250*c*.

In some embodiments, the first stage closed-loop cooling system 250 may include a first stage buffer tank 261. As shown in FIG. 2C, the first stage buffer tank 261 may be arranged such that the heated cooling liquid 260 passes through the first stage buffer tank 261 after exiting the first stage mud heat exchanger 232*a* and prior to entering the air cooler 254. In certain embodiments, the first stage buffer tank 261 may be sized such that the residence time of the heated cooling liquid 260 in the tank 261 facilitates an additional nominal drop in the temperature of the cooling liquid 260 of approximately a 1° F.-2° F. before it enters the air cooler 254.

As the cooling liquid 260 is heated by the hot drilling mud 210*h*/210*y* in the first stage mud heat exchanger 232*a*, the mud 210*h*/210*y* is also correspondingly cooled by the cooling liquid 260 during their passage through the first stage exchanger 232*a*. An intermediate (reduced) temperature drilling mud 210*i* may then exit the first stage mud heat exchanger 232*a* and pass to the second stage mud heat exchanger 232*b* for additional mud cooling (as may be required) in the manner further described below. In at least some embodiments, the first stage mud heat exchanger 232*a* may be, for example, a plate and frame heat exchanger and the like, which may thus provide large contact surface areas and high turbulence of the fluids flowing therethrough, thereby maximizing the overall heat transfer coefficient between the cooling liquid 260 and the hot drilling mud 210*h*/210*y*. However, it should be understood that other types of heat exchangers may also be used for the first stage mud heat exchanger 232*a* depending on the various overall design parameters of the mud cooler 230, such as the required mud temperature drop, mud flow rate, size and/or space limitations on the mud cooler 230, and the like.

In certain other embodiments, the size and/or configuration of the air cooler 254 may also be similarly adjusted based on the various design parameters of the first stage closed-loop cooling system 250. For example, the quantity and flow rate capacity of the induced draft fans 256 and the tube size and/or surface area of the cooling coil 255 may be optimized based on the anticipated ranges of the ambient operating conditions (e.g., ambient temperature and/or relative humidity, as previously described), the size and/or space limitations of the mud cooler 230, and the like.

As noted above, after the intermediate (reduced) temperature drilling mud 210*i* has exited the first stage mud heat exchanger 232*a*, it may then enter the second stage mud heat exchanger 232*b*, which is thermally coupled to the second stage closed-loop cooling system 270 by a second stage cooling liquid 280 that is circulated through both the second stage mud heat exchanger 232*b* and the second stage closed-loop cooling system 270 for further cooling, as may be required. In the second stage mud heat exchanger 232*b*, a portion of the heat contained in the intermediate temperature drilling mud 210*i* may be exchanged with the second stage cooling liquid 280, which subsequently flows through and is cooled by the second stage closed-loop cooling system 270. As with the first stage cooling liquid 260, the second stage cooling liquid 280 may be any suitable cooling liquid, such as water or a water/glycol mixture, and the like. Furthermore, as shown in FIG. 2C the cooling liquid 280 may be circulated through the second stage mud heat exchanger 232*b* and the second stage closed-loop cooling system 270 by a second stage fluid circulation pump 233*b*.

It should be appreciated that the term "closed-loop cooling system" as applied to the second closed-loop cooling system 270 may be understood in similar fashion as to how that term is applied to the first stage closed-loop cooling system 250 and described above. Accordingly, the second closed-loop cooling system 270 is also one wherein there is typically no loss of cooling liquid 280 from the system 270 to the environment, and where the addition of any further amount of cooling liquid 280 the system 270 during normal system operation is generally not required.

In the illustrative embodiment depicted in FIG. 2C, the cooling fluid 280 may be heated in the second stage mud heat exchanger 232*b* by the intermediate temperature drilling mud 210*i*, after which the heated cooling fluid 280 may exit the second stage mud heat exchanger 232*b* at a temperature 270*h*. The second stage fluid circulation pump 233*b* may then pump the heated cooling fluid 280 to the second stage closed-loop cooling system 270, where it passes through and is chilled by an evaporator 271. In some embodiments, the evaporator 271 may be part of a refrigeration system that includes first and second refrigeration chiller units 270*a/b*, as shown in FIG. 2C. The first and second refrigeration chiller units 270*a/b* may include respective cooling coils 272*a/b*, as well as several other refrigeration unit components as will be described in further below. In certain embodiments, the heated cooling fluid 280 may be chilled as it flows through the evaporator 271 by exchanging heat with a refrigerant 290 that is passing through one or both of the cooling coils 272*a/b*. After being chilled in the evaporator 271, the chilled cooling fluid 280 may then be circulated out of the second stage closed-loop cooling system 270 and back to the second stage mud heat exchanger 232*b*, which it may then re-enter at a temperature 270*c*.

As the cooling fluid 280 is heated by the intermediate temperature drilling mud 210*i* in the second stage mud heat exchanger 232*b*, the intermediate temperature mud 210*i* is also correspondingly cooled by the cooling fluid 280 during their respective passage through the second stage exchanger 232*b*. Accordingly, cooled drilling mud 210*c*/210*z* may exit the second stage mud heat exchanger 232*b*, where it may then be circulated through the system 200 as previously described (see, FIGS. 2A and 2B). Additionally, as noted with respect to the first stage mud heat exchanger 232*a* above, in certain illustrative embodiments the second stage mud heat exchanger 232*b* may also be a plate and frame heat exchanger, although it should be understood that other types of heat exchangers may also be used for the second stage mud heat exchanger 232*b*, depending on the overall design parameters of the mud cooler 230.

As noted above, the heated second stage cooling fluid 280 exiting the second stage mud heat exchanger 232*b* may be chilled in the evaporator 271 by a refrigerant 290 passing through at least one of the dual cooling coils 272*a/b*. As shown in FIG. 2C and noted above, in at least some exemplary embodiments of the present disclosure, the cooling coils 272*a/b* disposed in the evaporator 271 may be one of several components of the respective first and second refrigeration chiller units 270*a/b*, which may also include respective compressors 273*a/b*, respective condensing coils 275*a/b* disposed in a condensing unit 274, and respective expansion devices 278*a/b*. Additionally, in at least some embodiments, the first and second refrigeration chiller units 270*a/b* may also include respective flash tanks 277*a/b*, as will be described in further detail below. Furthermore, it should be understood that the refrigerant 290 may be any appropriate type of refrigerant known in the art, such as, for example R134A (1,1,1,2-tretrafluoroethane) and the like, although other types of refrigerants may also be used.

In an exemplary embodiment wherein the refrigerant 290 is passing through both of the cooling coils 272*a/b*, after the refrigerant 290 has exchanged heat with and chilled the second stage cooling fluid 280 in the evaporator 271, the refrigerant 290 exits the respective cooling coils 272*a/b* as a warm low pressure vapor 290*a*. Thereafter, the warm low pressure vapor 290*a* may enter the suction side of a respective compressor 273*a/b*, where the pressure and temperature of the refrigerant 290 are both increased and the refrigerant exits the compressors 273*a/b* as a high pressure superheated gas 290*b*. In certain illustrative embodiments, the compressors 273*a/b* may be, for example, rotary screw compressors and the like, although it should be understood that other types of compressors may also be used, depending on the specific design parameters and desired operational characteristics of the refrigeration chiller units 270*a/b* of the second closed-loop cooling system 270.

After exiting the discharge side of the respective compressors 273*a/b*, the high pressure superheated gas 290*b* may then enter the respective condensing coils 275*a/b* of the condensing unit 274. A plurality of induced draft cooling fans 276 mounted on the condensing unit 274 may then cool the high pressure superheated gas 290*b* by drawing air a flow of air across each of the respective condensing coils 275*a/b*, thereby rejecting the heat that is absorbed by the refrigerant 290 from the cooling fluid 280 in the evaporator 271 as well as the heat that is added to the refrigerant 290 in the compressors 273*a/b* by dissipating the heat to the atmosphere, as is schematically depicted by the heat flow lines 279 shown in FIG. 2C. After being cooled in the condensing unit 274, the cooled refrigerant exits the respective coils 275*a/b* as a high pressure subcooled liquid 290*c*, which may also include some amount of vapor.

In some embodiments, after the high pressure subcooled liquid refrigerant 290*c* has exited each of the respective condensing coils 275*a/b*, it may then be circulated to the respective expansion devices 278*a/b*—which may be, for example, expansion valves or metering orifices and the like—where the pressure of the refrigerant 290 may be dropped in a controlled manner so as to create low pressure subcooled liquid refrigerant 290*e*. The low pressure subcooled liquid refrigerant 290*e* then passes back to the evaporator 271, where it vaporizes into the warm low pressure gas 290*a* as it absorbs heat from the second stage cooling fluid 280, as previously described. In other embodiments, such as when a respective flash tank 277*a/b* may be included in the first and second refrigeration chiller units 270*a/b*, the high pressure subcooled liquid refrigerant 290*c* may first pass through the respective flash tanks 277*a/b*, and any refrigerant vapor 290*d* mixed with the liquid refrigerant 290*c* coming from the condensing unit 274, or that may flash off of the liquid refrigerant 290*c* in the flash tanks 277*a/b*, may then be redirected back to the respective compressors 273*a/b* for compression and subsequent re-cooling through the condensing unit 274. Thereafter, the high pressure subcooled liquid 290*c* passes from the flash tanks 277*a/b* to the expansion devices 278*a/b* and on to the evaporator, as described above.

In some embodiments, the second stage closed-loop cooling system 250 may also include a second stage buffer tank 281. As shown in FIG. 2C, the second stage buffer tank 281 may be arranged such that the heated cooling fluid 280 passes through the second stage buffer tank 281 after exiting the second stage mud heat exchanger 232*b* and prior to entering the evaporator 271. In certain embodiments, the second stage buffer tank 281 may be sized such that the residence time of the heated cooling fluid 280 in the tank 281 facilitates an additional nominal drop in the temperature of the cooling fluid 280 of approximately a 2° F.-5° F. before entering the evaporator 271.

Additionally, the size and/or configuration of the condensing unit 274 may also be adjusted based on the various design parameters of the second stage closed-loop cooling system 270. For example, in some embodiments, the quantity and flow rate capacity of the induced draft fans 276 and the tube size and/or surface area of the condensing coils 275*a/b* may be optimized based on the anticipated ranges of the ambient operating conditions (e.g., ambient temperature and/or relative humidity, as previously described), the overall size and/or space limitations of the mud cooler 230, and the like. Furthermore, while FIG. 2C schematically depicts that the condensing coils 275*a/b* are both part of a common condensing unit 274, it should be understood that, depending on the design and/or layout of the second closed-loop cooling system 270, individual condensing units may be used for each of the respective condensing coils 275*a* and 275*b*.

The mud cooler 230 may be adapted to cool drilling mud under a wide range of ambient temperature conditions, such as between a low ambient temperature of approximately 35° F.-40° F. and a high ambient temperature of approximately 120° F.-125° F. Furthermore, the mud cooler 230 may also be adapted to receive and cool hot drilling mud 210*h*/210*y* which has a temperature that ranges as high as approximately 150° F.-200° F. and a mud flow rate between about 300 gpm and 500 gpm, or even greater. In some embodiments, the control system 295 may be adapted to control the operation of the various elements of the mud cooler 230, e.g., the first and second closed-loop cooling systems 250 and 270 and the like, under such ambient temperature and hot mud flow rate and temperature conditions so that the intermediate temperature drilling mud 210*i* exits the first stage mud heat exchanger 232*a* having a temperature that is between about 145° F.-150° F., and so that the cooled drilling mud 210*c*/210*z* exits the second stage mud heat exchanger 232*b* at a temperature that ranges from about 120° F.-130° F. In such embodiments, the control system 295 may also control the first stage closed-loop cooling system 250 so that the temperature 250*c* of the cooled first stage cooling fluid 260 as it enters the first stage mud heat exchanger 232*a* ranges between about 120° F.-125° F. and the subsequently heated cooling liquid 260 exits the first stage exchanger 232*a* with a temperature 250*h* ranging from 140° F.-145° F.

Furthermore, the second closed-loop cooling system 270 may be controlled so that the temperature 270*c* of the chilled second stage cooling liquid 280 entering the second stage mud heat exchanger 232*b* ranges from approximately 55° F.-60° F. and temperature 270*h* of the subsequently heated cooling liquid 280 exiting the second stage exchanger 232*b* is between about 65° F.-70° F.

As noted above, the control system 295 may be configured and/or programmed to control the operation of the mud cooler 230 under a variety of operating conditions, including varying ambient conditions, varying hot drilling mud temperatures and/or flow rates, and/or varying cooled drilling mud set point temperatures, and the like. Following is a description of one illustrative drilling mud cooler control methodology that may be used by the control system 295 to achieve a desired temperature of the cooled drilling mud 210*c* by adjusting the amount of drilling mud cooling that is provided by the mud cooler 230 through a sequentially staged operation of the first and second stage closed-loop cooling systems 250 and 270.

As an initial step in controlling the operation of the mud cooler 230, a predetermined mud set point is established as the target temperature of the cooled drilling mud 210*c* exiting the mud cooler 230 (in the case of the system 200 of FIG. 2A) or of the cooled drilling mud 210*c* exiting the cooled mud tank 211*c* (in the case of the system 200 of FIG. 2B). In some embodiments, the mud set point temperature may be programmed into the control system 295 through an appropriate human/machine interface (HMI) system 296, such as a control panel, computer screen and keyboard, and/or any other appropriate HMI system known in the art. In some embodiments, the mud set point temperature may be in the range of about 120° F.-140° F., whereas in at least one embodiment the mud set point temperature may be approximately 135° F., although it should be appreciated that other mud set point temperatures may also be used, depending on the overall operational requirements of the system 200 and the mud cooler 230.

During operation of the mud circulation system 200 (see, FIGS. 2A and 2B), the control system 295 continuously monitors the incoming temperature of the hot drilling mud 210*h*/210*y* flowing through the flow line 205. When the temperature of the hot mud 210*h*/210*y* exceeds the mud set point temperature, the control system 295 controls the operation of the first and second closed-loop cooling systems 250 and 270 so as to sequentially stage on and off as required in order to lower the temperature of the cooled drilling mud 210*c* down to at least the targeted mud set point temperature. For example, during an early phase of a drilling operation, the temperature of the hot drilling mud 210*h*/210*y* returning from the wellbore 201 may initially stay below the mud set point temperature, e.g., 120° F., when the wellbore 201 is initially relatively shallow and has not yet reached wellbore depths having high formation temperatures, and/or the amount of heat generated by the actual crushing or shearing of rock remains relatively low. In such early-phase low temperature drilling operations, both the first and second closed-loop cooling systems 250 and 270 may remain in a cooling standby mode until such time as the temperature of the mud returning from the wellbore, i.e., the hot drilling mud 210*h*/210*y*, rises above the mud set point temperature. Once the temperature of the hot drilling mud 210*h*/210*y* exceeds the mud set point, the control system 295 may then initiate operation of the first and second stage closed-loop cooling systems 250 and 270 in sequential stages based upon the overall cooling requirements necessary to bring the drilling mud temperature of the cooled drilling mud 210*c* at least down to the predetermined drilling mud set point temperature. Therefore, the control system 295 may initially start up the first stage closed-loop cooling system 250 so as to begin cooling the hot drilling mud 210*h*/210*y*; however, the second stage closed-loop cooling system 270 may remain in the cooling standby mode until additional mud cooling capacity is required, as will be further described below.

In some embodiments, operation of the first stage closed-loop cooling system 250 is initiated by first starting up the cooling fans 256 of the air cooler 254. In certain embodiments, the cooling fans 256 may be started up sequentially by the control system 295 with a fixed time delay between the startup of each fan 256, such as approximately 10 seconds, so as to minimize any spiking of the power requirements imposed on the power system (not shown) that is used to supply power to the mud cooler 230. After all of the cooling fans 256 have been brought on line, the control system 295 may then initiate operation of the first stage fluid circulation pump 233*a* so as to ramp up the flow rate of the first stage cooling liquid 260 through the cooling coil 255 of the air cooler 254 to approximately the maximum normal operating capacity of the first stage pump 233*a*. In this way, the cooling capacity of the first stage closed-loop cooling system 250 may be substantially maximized so that the second stage closed-loop cooling system 270 may remain off line and in cooling standby mode until the cooling capacity of the first stage closed-loop cooling system 250 is no longer sufficient to keep the mud temperature of the cooled drilling mud 210*c* at or below the predetermined mud set point temperature.

In certain embodiments, the control system 295 may operate the first stage closed-loop cooling system 250 at substantially a constant maximum cooling capacity as described above—i.e., based on the maximum flow capacities of the cooling fans 256 and the first stage fluid circulation pump 233*a*—and only bring the second stage closed-loop cooling system 270 on line and out of cooling standby mode as may be required to provide additional mud cooling. Furthermore, the first stage closed-loop cooling system 250 may be operated continuously at the maximum capacities noted above until the drilling conditions and/or the ambient atmospheric conditions are such that the temperature of the hot drilling mud 210*h*/210*y* flowing through the system 200 drops by a predetermined number of degrees below the mud set point temperature, such as by approximately 2° F.-4° F. When such a hot drilling mud temperature condition occurs, the control system 295 may then shut down the first stage closed-loop cooling system 250 so as to conserve power. The first and second closed-loop cooling systems 250 and 270 may then both remain in the cooling standby mode until such time as the temperature of the hot drilling mud 210*h*/210*y* rises back up to and/or above the predetermined mud set point temperature, at which time the first stage closed-loop cooling system 250 may be brought back on line so as to provide the requisite mud cooling.

In other illustrative embodiments, when the first stage closed-loop cooling system 250 is being operated continuously at substantially the maximum flow rate and cooling capacities noted above and the temperature of the cooled drilling mud 210*c* exiting the mud cooler 230 in the system 200 of FIG. 2A (or the cooled mud tank 211*c* in the system 200 of FIG. 2B) rises above the predetermined mud set point temperature, the control system 295 may then operate to initiate startup of the second stage closed-loop cooling system 270 so as to provide additional mud cooling capacity and to bring the temperature of the cooled drilling mud 210*c* down below the mud set point temperature. Such an increased temperature of the cooled drilling mud 210*c* may occur for a variety of reasons. For example, the moving mud temperature at the bottom of the wellbore 202—generally caused by a combination of the formation temperature and the heat generated by the drilling operation—may rise above temperature level that the mud cooler 230 is capable of lowering below the predetermined mud set point temperature by operation of the first stage closed-loop cooling system 250 alone. Additionally, the ambient conditions of the environment surrounding the mud cooler, e.g., the ambient temperature and/or relative humidity, may have changed in such a manner as to reduce the efficiency and/or overall cooling capability of the first stage closed-loop cooling system 250, such as change from nighttime drilling operations to daytime drilling operations. Moreover, in some embodiments, a combination of both the mud temperature and ambient environment parameters may contribute to the rise in the temperature of the cooled drilling mud 210*c* above the predetermined mud set point temperature.

In operation, when the control system 295 initiates startup of the second stage closed-loop cooling system 270, the first refrigeration unit 270*a* of the second stage closed-loop cooling system 270 will be initially brought on line so as to handle the additional cooling requirements needed to address the increase in temperature of the cooled drilling mud 210*c*. In order to reduce overall power consumption to the mud cooler 230, the operation of the first refrigeration unit 270*a* will ramp up gradually and/or incrementally only so as to meet the necessary cooling requirements to reduce the temperature of the cooled drilling mud 210*c* down to at least the mud set point temperature. On the other hand, the second refrigeration unit 270*b* may remain off line and in standby cooling mode until such time as the additional cooling capacity provided by first refrigeration unit 270*a* alone cannot meet the cooling needs of the mud cooler 230. In other words, second refrigeration unit 270*b* of the second stage closed-loop cooling system 270 will not brought on line and off of cooling standby until the overall mud cooling that is provided by the first stage closed-loop cooling system 250 and the first refrigeration unit 270*a* is insufficient to keep the temperature of the cooled drilling mud 210*c* at or below the predetermined mud set point temperature. In this way, not only may the control system 295 be adapted to conserve power by sequentially staging the operation of the first and second stage closed-loop cooling systems 250 and 270, the control system 295 may also be adapted to further conserve power by sequentially staging the operation of the first and second refrigeration chiller units 270*a/b* of the second stage closed-loop cooling system 270.

In certain exemplary embodiments, the control system 295 may be adapted to control each of the first and second refrigeration chiller units 270*a/b* at or below a predetermined maximum percentage of the refrigeration unit's capacity so as to optimize the efficiency of the refrigeration chiller units 270*a/b* and thereby minimize overall power consumption. For example, in at least some embodiments, the control system 295 may control the first and second refrigeration chiller units 270*a/b* so that each operates at or below no more than approximately 75% of the maximum refrigeration capacity. Accordingly, in such embodiments, when the first refrigeration unit 270*a* of the second stage closed-loop cooling system 270 is operating alone at approximately 75% of its rated capacity and the temperature of the cooled drilling mud 210*c* exiting the mud cooler exceeds the predetermined mud set point temperature, the control system 295 may then operate to bring the second refrigeration unit 270*b* on line, i.e., off of cooling standby mode, while maintaining the operation of the first refrigeration unit 270*a* at a substantially constant 75% of rated capacity. As with the controlled operation of the first refrigeration unit 270*a*, the control system 295 may then also control the operation of the second refrigeration unit 270*b* by ramping up gradually and/or incrementally only as needed to meet the additional cooling requirements necessary to reduce the temperature of the cooled drilling mud 210*c* down to at least the mud set point temperature.

As the overall cooling requirements of the mud cooler 230 decrease, e.g., as the ambient temperature, and/or the temperature or flow rate of the hot drilling mud 210*h*/210*y* decreases, the control system 295 may be operated so as to shut down, i.e., take off line, each of the various components of the mud cooler 230 in a reverse sequence to that used to bring the component on line as set forth above. For example, the control system 295 may be used to gradually or incrementally ramp down the operation the second refrigeration unit 270*b*, eventually take the second refrigeration unit 270*b* off line to standby cooling mode, as the mud cooling requirements decrease. Thereafter, the first refrigeration unit 270*a* may be ramped down and taken off line to standby cooling mode in similar fashion. The first stage closed-loop cooling system 250 will then be controlled by the control system 295 so as to perform at substantially maximum cooling capacity until the temperature of the hot drilling mud 210*h*/210*y* entering the first stage mud heat exchanger 232*a* drops below the mud set point temperature by the previously noted predetermined number of degrees, e.g., by approximately 2° F.-4° F. as described above.

As a result, the subject matter disclosed herein provides details of various systems, apparatuses, and methods that may be used for circulating and cooling drilling mud during wellbore drilling operations, and in particular, during high temperature onshore drilling operations. Furthermore, in some illustrative embodiments, a control system 295 may be used to adjust the amount of drilling mud cooling that is provided by the mud cooler 230 through a sequentially staged operation of the first and second stage closed-loop cooling systems 250 and 270 by bringing the second stage closed-loop cooling system 270 on line only as required to provide additional mud cooling capacity. Additionally, the control system 295 may also be used to sequentially stage the operation of the first and second refrigeration chiller units 270*a/b* of the second stage closed-loop cooling system 270 in a similar fashion, i.e., by bringing the second refrigeration chiller unit 270*b* on line only when the drilling mud cooling requirements so dictate. In this way, the control system may be adapted to optimize power consumption across all stages of the mud cooler 230 operational cycle.

The particular embodiments disclosed above are illustrative only, as the invention may be modified and practiced in different but equivalent manners apparent to those skilled in the art having the benefit of the teachings herein. For example, the method steps set forth above may be performed in a different order. Furthermore, no limitations are intended by the details of construction or design herein shown. It is therefore evident that the particular embodiments disclosed above may be altered or modified and all such variations are considered within the scope and spirit of the invention. Accordingly, the protection sought herein is as set forth in the claims below.

What is claimed:

1. A method for cooling drilling mud, the method comprising:

routing the drilling mud from a wellhead to a first heat exchanger in fluid communication with an air-cooled and closed-loop cooling system;

controlling the air-cooled and closed-loop cooling system to cool the drilling mud via the first heat exchanger when a first temperature of the drilling mud exceeds a first predetermined mud set point temperature;

routing the drilling mud from the first heat-exchanger to a second heat exchanger in fluid communication with a refrigeration chiller unit; and controlling the refrigeration chiller unit to further cool the mud via the second heat exchanger when a second temperature of said flow of drilling mud that has been cooled by said air-cooled and closed-loop cooling system exceeds a second predetermined mud set point temperature.

2. The method of claim 1, wherein controlling operation of said air-cooled and closed-loop cooling system comprises:

maintaining said air-cooled and closed-loop cooling system in a mud cooling standby mode when said first temperature is below said first predetermined mud set point temperature; and cooling said flow of drilling mud with a first cooling fluid circulating through said air-cooled and closed-loop cooling system when said first temperature rises to at least said first predetermined mud set point temperature.

3. The method of claim 2, wherein controlling operation of said refrigeration chiller unit comprises:

maintaining said refrigeration chiller unit in a mud cooling standby mode when said second temperature is below said second predetermined mud set point temperature; and cooling said flow of drilling mud with a second cooling fluid circulating through said refrigeration chiller unit when said second temperature rises to at least said second predetermined mud set point temperature.

4. The method of claim 1, wherein the first predetermined mud set point temperature and the second predetermined mud set point temperature are a same temperature.

5. The method of claim 1, further comprising receiving drilling mud from a shaker into a first mud tank and circulating the drilling mud from the first mud tank directly into a second mud tank.

6. The method of claim 5, further comprising circulating drilling mud from the second mud tank to the air-cooled and closed-loop cooling system.

7. The method of claim 6, further comprising circulating drilling mud from the air-cooled and closed loop cooling system or the refrigeration chiller unit to the first mud tank.

8. A method for cooling drilling mud, the method comprising:

routing the drilling mud from a wellhead to a first heat exchanger in fluid communication with an air-cooled and closed-loop cooling system;

controlling the air-cooled and closed-loop cooling system to cool the drilling mud when a first temperature of the drilling mud exceeds a first predetermined mud set point temperature, wherein controlling the air-cooled and closed-loop cooling system comprises circulating a first cooling fluid through the first air-cooled closed-loop cooling system and cooling the drilling mud with the first cooling fluid via the first heat exchanger;

routing the drilling mud from the first heat exchanger to a second heat exchanger in fluid communication with a refrigeration chiller unit; and controlling the refrigeration chiller unit to cool the drilling mud when a second temperature of the drilling mud that has been cooled by the air-cooled closed-loop cooling system exceeds a second predetermined mud set point temperature, wherein controlling the refrigeration chiller unit comprises circulating a second cooling fluid through the refrigeration chiller unit and cooling the drilling mud with the second cooling fluid via the second heat exchanger.

9. The method of claim 8, wherein controlling operation of said air-cooled and closed-loop cooling system comprises maintaining said closed-loop cooling system in a mud cooling standby mode when said first temperature is below said first predetermined mud set point temperature and initiating operation of said air-cooled and closed-loop cooling system when said first temperature rises to at least said first predetermined mud set point temperature.

10. The method of claim 9, wherein controlling operation of said refrigeration chiller unit comprises maintaining said refrigeration chiller unit in a mud cooling standby mode when said second temperature is below said second predetermined mud set point temperature and initiating operation of said refrigeration chiller unit when said first temperature rises to at least said second predetermined mud set point temperature.

11. The method of claim 8, wherein the first predetermined mud set point temperature and the second predetermined mud set point temperature are a same temperature.

12. The method of claim 8, wherein said refrigeration chiller unit comprises first and second refrigeration chiller units and the method further comprises sequentially staging operation of the first and second refrigeration chiller units.

13. The method of claim 8, further comprising receiving drilling mud from a shaker into a first mud tank and circulating the drilling mud from the first mud tank directly into a second mud tank.

14. The method of claim 13, further comprising circulating drilling mud from the second mud tank to the air-cooled and closed-loop cooling system.

15. The method of claim 14, further comprising circulating drilling mud from the air-cooled and closed-loop cooling system or the refrigeration chiller unit to the first mud tank.

* * * * *